US005454125A

United States Patent [19]

Ratkowski

[11] Patent Number: 5,454,125

[45] Date of Patent: Oct. 3, 1995

[54] SELF-CONTAINED MULTIPURPOSE COMFORT DEVICE

[76] Inventor: Randall J. Ratkowski, 43122 Via Dos Picos, Suite C, Temecula, Calif. 92590

[21] Appl. No.: 234,930

[22] Filed: Apr. 28, 1994

[51] Int. Cl.[6] ..... A47G 9/06

[52] U.S. Cl. ..... 5/417; 5/419; 383/4

[58] Field of Search ..... 5/417–420, 485; 383/4; 2/88, 89, 69

[56] References Cited

U.S. PATENT DOCUMENTS

| | | | |
|---|---|---|---|
| 1,930,942 | 10/1933 | Pringle | 5/419 |
| 2,451,142 | 10/1948 | Zimmern | 383/4 |
| 2,783,473 | 3/1957 | Humpeler | 5/417 |
| 3,041,638 | 7/1962 | Lo Vico | 5/419 |
| 4,278,719 | 7/1981 | Sarnecki | 5/417 |
| 4,590,714 | 5/1986 | Walker | 5/417 |
| 4,703,528 | 11/1987 | Rolle | 5/417 |
| 5,099,530 | 3/1992 | Scott | 5/419 |

FOREIGN PATENT DOCUMENTS

| | | | |
|---|---|---|---|
| 2626152 | 7/1989 | France | 5/417 |

*Primary Examiner*—Flemming Saether
*Attorney, Agent, or Firm*—Richard R. Mybeck; Peter B. Scull

[57] ABSTRACT

A self-contained comfort device having a generally rectangular body portion and two pocket members disposed one on each surface of the body portion for containing the device when the device is folded and the pocket member is inverted thereabout. A generally rectangular resilient pad is incorporated within one of the pocket members. Preferably, the device is made with fleece on one surface and water-resistant material on the other. Customized logos may also be imprinted or embroidered on either surface.

5 Claims, 1 Drawing Sheet

LOGO

SELF-CONTAINED MULTIPURPOSE COMFORT DEVICE

INTRODUCTION

The present invention relates generally to a self-contained, multipurpose comfort device and more particularly, to a versatile article which may be selectively used as a seat cushion, a blanket with a built-in pillow or seat cushion, a lap robe, and as a water repellant shawl, all of which is foldable into a unique self-contained, easily transported unit.

BACKGROUND OF THE INVENTION

Enjoying a picnic while seated on a blanket is an old custom and a favorite pastime. Watching your favorite football team under a crisp October sky wrapped snugly in a blanket is another favorite pastime. Watching a football game while getting drenched in November is even considered by some to be fun. Stretching out on a favorite beach blanket, developing a summer tan, takes many hours and careful consideration. Whatever the sport, wherever the picnic, and however many hours invested in the summer tan, some items which are considered a "must" are blankets and pillows or seat cushions.

Heretofore, the above activities have involved a plethora of paraphernalia, namely, seat cushions, blankets, waterproof/water repellant covers, and pillows. Inarguably, each of the above named items performs its intended function well. However, each item is capable of performing only its single designed function. If a recreational event requires all of these items, a burden is created which one person cannot carry alone, especially when a beverage cooler and food carrier are also essential to a successful outing.

Accordingly, in the past, an individual who desired to have, for example, both a cushion to sit upon and a blanket or lap robe at a certain event, would have to bring, and carry both items. This is bulky and awkward. Further, in the event of rain, a rain cover would be required adding further to the bulk and the clutter. Finally, most folded items such as blankets, either require an additional storage container, or they tend to lose their shape making them hard to carry. Neither outcome is desirable.

Prior art attempts to reduce the number of discrete items carried by an individual to respond to a multiplicity of anticipated needs include a sleeping bag for children which incorporates a stuffed toy in its structure (See: Mills, U.S. Pat. No. 4,774,374, and the references cited therein), and a device currently marketed under the trade name "Pillow Pouch" bearing the marking "Ser. No. 07/751,207." However, none of these prior art devices provide a structure which allows a single integral device to be multifunctional for use as a seat cushion per se, or as a seat cushion in combination with a lap robe, or as a blanket in combination with a pillow, or even as a pillow per se, not to mention also providing a weather resistant waterproof/water repellant covering when needed. Further, none of the prior devices provide for or suggest a compact self-contained storage/carrying mode without requiring additional and/or extraneous parts. It is toward the resolution of these prior art shortcomings that the present invention is directed.

BRIEF SUMMARY OF THE INVENTION

The present invention provides a self-contained multipurpose comfort device which may be selectively converted into a seat cushion, a pillow, a blanket with a built-in pillow/seat cushion, a lap robe, a waterproof/water repellant weather resistant covering, and which can be stored or carried in a neat compact manner without the need for a carrying case. The device comprises a generally rectangular body portion having a first and a second pocket member strategically disposed on opposite faces thereof, a resilient and generally rectangular foam pad inserted within the lining of the first pocket member, the first and the second pocket members, each including an invertible pocket wall. Preferably, one surface of the blanket will be formed of fleece, cotton, polyester, or other similar comfort-inducing fabric, while the obverse surface will be formed of a suitable waterproof/water repellant material such as GORETEX, NYLON, or like materials. The strategically placed pocket members are secured to each face of the body portion and permit the body of the device to be neatly stored therein to provide either a pillow or a weather resistant seat cushion.

Accordingly, the primary object of the present invention is to provide a self-contained multipurpose comfort device which can be selectively and readily employed as a seat cushion, a pillow, a blanket-pillow assembly, a lap robe, or a waterproof/water repellant shawl.

Another object of the present invention is to provide a multi-purpose article of the nature described which can be easily folded and stored within an integral pocket defined therein without recourse to external packaging or extraneous fastening means.

These and still further objects, as shall hereinafter appear, are readily fulfilled by the present invention in a remarkably unexpected fashion as will be readily discerned from the following detailed description of an exemplary embodiment thereof, especially when read in conjunction with the accompanying drawing in which like parts bear like numerals throughout the several views.

DESCRIPTION OF PREFERRED EMBODIMENT

Figures 1, 2, 3, 4, 5, 6:
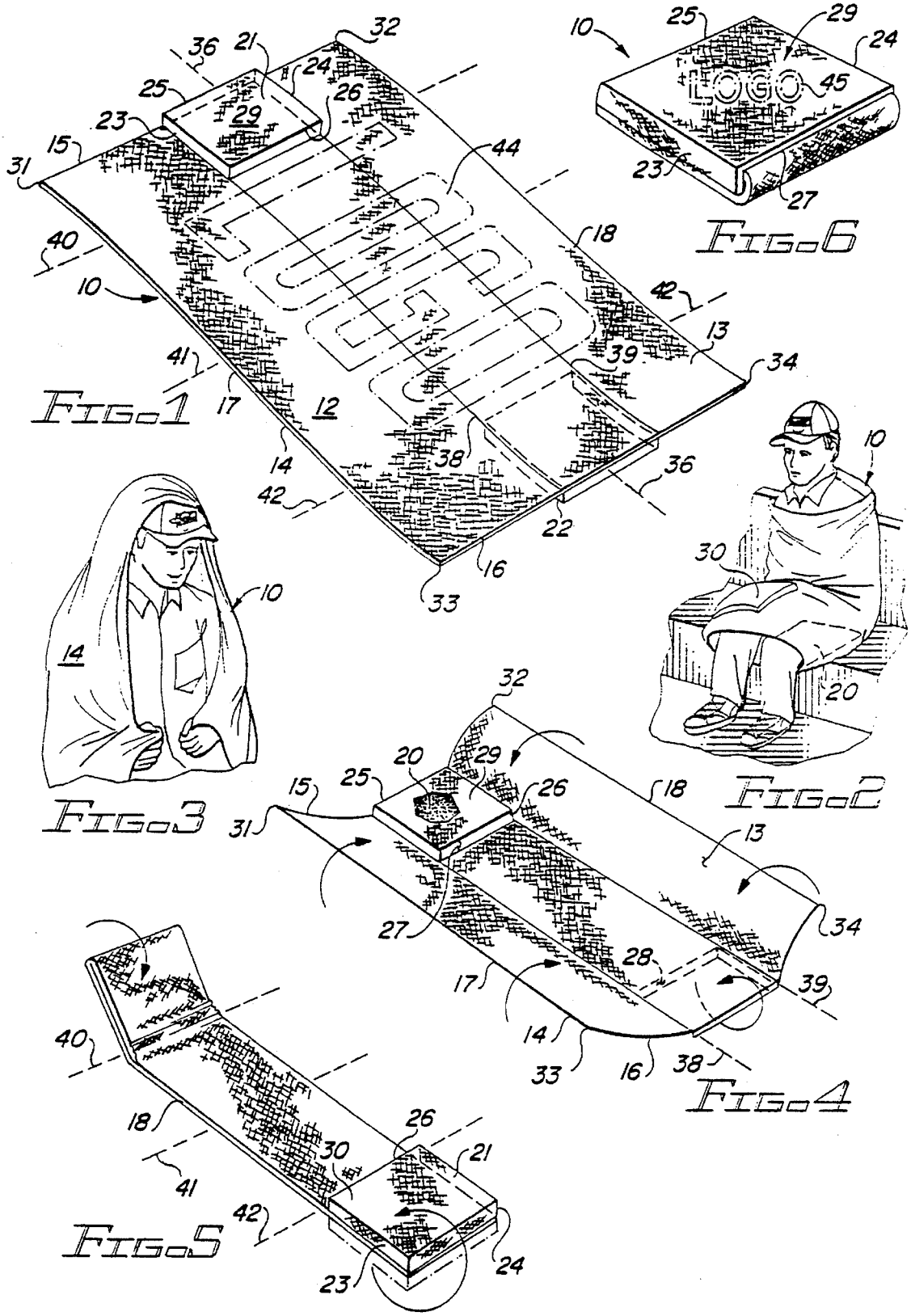
FIG. 1 is an isometric view of the device embodying the present invention in a fully unfolded state.
FIG. 2 is an isometric view of the device of FIG. 1 in use as a combination seat cushion and lap robe.
FIG. 3 is an elevation of the device of FIG. 1 in use as a shawl or weather protective cover.
FIG. 4 is an isometric view of the device of FIG. 1 in a partially folded state.
FIG. 5 is an isometric view of the device of FIG. 4 in a further folded state.
FIG. 6 is a view of the device of FIG. 4 when it is completely folded and placed within a pocket for use or transport.

The present invention relates to a self-contained multipurpose comfort device identified herein by the general reference 10. As shown in FIGS. 1–6, device 10 comprises a generally rectangular body portion 12 having a first planar surface 13 and a second planar surface 14 which surfaces are disposed in substantially congruous back-to-back relationship to each other and extend between an upper end or edge 15, a lower end or edge 16, proximal side edge 17 and distal side edge 18. A polyhedral resilient pad 20 formed of a suitable material such as foam rubber or the like is secured in place midway between edges 17, 18, and adjacent lower edge 16 in a manner which will be further explained below.

First and second rectangular fabric pocket-defining members, 22 and 22, respectively, are suitably attached as by sewing, at their side edges 23 and 24 and lower edge 25 respectively, to planar surfaces 13 and 14 respectively. Each member 21, 22 is positioned so as to dispose the unattached edge 21 toward the center of body portion 12 as shown in FIGS. 1 and 4. Members 21, 22 thus coact with surfaces 13, 14, to define open mouths 27 and 28 which provide access to open-mouthed pockets 29 and 30, respectively. In one practice, fabric member 21 will be more than twice as long as fabric member 22 to enable one end of member 21 to fold back over and wrap resilient pad 20 therewithin and "sandwich" pad 20 between its folds. When wrapped as described, pad 20, will form one wall, preferably the outer wall, of pocket 29. Pad 20 will be of various thicknesses, preferably from about one to about four inches.

In the preferred practice of the present invention, body portion 12 will be substantially rectangular in shape, and edges or ends 15, 16 will be short compared to edges or sides 17, 18 which are longer. The end edges 15, 16 extend between and meet side edges 17, 18 to define four corners, 31, 32, 33, and 34. As shown in FIG. 1, body member 12 has a central longitudinal axis 36 which is intermediate and parallel to long or side edges 17, 18, and is perpendicular to and bisects both ends or short edges 15, 16 as well as bisecting pockets 29, 30. As described, each pocket 29, 30 has a mouth or opening 27, 28 respectively, which faces the center of member 12 and which extends perpendicular to and is bisected by longitudinal axis 36.

Thus, body portion 12, resilient pad 20 and pockets 29, 30 are substantially symmetrical about longitudinal axis 36 as shown in FIG. 1. Body portion 12 also has theoretical longitudinal fold lines 38, 39 and transverse fold lines 40, 41, and 42 defined thereupon. Longitudinal fold lines 38, 39 are disposed in spaced parallel relationship to each other and parallel to axis 36 so as to trisect end edges 15 and 16. As shown, fold lines 38, 39 are coaxial with edges 23, 24 of pockets 29, 30 respectively. Transverse fold lines 40, 41, and 42 are positioned in spaced parallel relationship to each other and perpendicular to longitudinal axis 36 and are effective to divide side edges 17 and 18 into four equal portions. Fold lines 38, 39, and 40–42 are not actually marked on device 10 but are shown in the drawings to facilitate the description of the folding required to utilize the self storage feature of the invention. Suitable logos 44, 45 may be inscribed as by embroidery, silk-screening or like methods on either surface 13, or surface 14, and/or on the interior surface of fabric pocket member 21, 22. In preferred practice, logo 45 will be located on the interior surface of at least one of the fabric pocket members 21, 22 so that when the pocket has been inverted, logo 45 will be exposed to view when device 10 is completely folded.

Device 10 is preferably made from three different materials. First planar surface 13 will be fleece, cotton or some other blanket-like material, while second planar surface 14 will be NYLON, GORETEX, or like water-repellant or waterproof material, and seat cushion pad 20 is any suitable padding material such as polyurethane or foam rubber. In practice, pad 20 will be approximately one to about four inches thick.

Device 10 is simply constructed in that the first and second planar surfaces 13 and 14 are essentially the same size and can be readily sewn or otherwise connected to each other. Thus, each surface 13, 14 completely overlays the other surface in back to back, geometrically congruent relationship.

Further, fabric pocket-defining members 21 and 22 are readily sewn or otherwise attached to surfaces 13 and 14 at the locations defined above and shown in FIG. 1. However, before attaching pocket members 21, 22, pad 20 is integrally wrapped in pocket member 21, as described above. Fabric pocket members 21 and 22 are then attached to device 10 along three of the rectangular sides thereof leaving mouths or openings 27, 28 leading into pockets 29, 30 via the fourth, unattached edges of members 21, 22 thereof facing the centers of the respective surfaces 13, 14.

In operation, device 10 may be fully unfolded as shown in FIG. 1 and used as a blanket built-in pillow combination wherein pad 20 serves as the pillow. Alternatively as shown in FIG. 2, one may sit upon covered pad 20, now serving as a seat cushion, and drape body portion 12 over one's lap as a lap robe. FIG. 3 shows device 10 wrapped over one's head and shoulders as a shawl for protection from inclement weather. In this use, waterproof surface 14 will be preferably exposed to and will repel the weather elements.

When completely folded in the manner to be described with reference to FIGS. 4, 5, and 6, device 10 serves as simple seat cushion or as a pillow, depending on whether surface 13 is folded inwardly or exposed. Upon completing the folding sequence, device 10 defines a compact unit for easy transportation and storage.

Attention should be given to whether the fleece-like surface 13 is exposed or whether it is faced down, whereupon weather resistant surface 14 is exposed. It is preferred that when device 10 is completely folded in the manner to be described and the fleece-like surface 13 is exposed, device 10 will be used as a pillow while when device 10 is folded to expose the weather proof material of surface 14, it will be used as a seat cushion.

To fold device 1 into the compact unit shown in FIG. 6 refer to FIGS. 1, 4, and 5. Body portion 12 is first folded inwardly along longitudinal fold lines 38 and 39 as shown in FIG. 4, where side edge 17 is folded over fold line 38 and aligned with fold line 39. Side edge 18 is then folded over edge 17 along fold line and aligned with fold line 38. When these folds are accomplished correctly, corners 32 and 34 will be aligned with fold line 38 and corners 31 and 33 will be aligned with the fold line 39. At this point, one of the two pockets 29, 30 is left uncovered. Proceeding from FIG. 4 to FIG. 5, this uncovered pocket, 29 for example, may then be inverted or turned inside out to engulf corners 33, 34 and device 10 folded along transverse fold lines 40, 41 and 42, respectively as shown in FIG. 5. The last fold puts all of device 10 inside of pocket 29.

Alternatively, the folds along transverse fold lines 40, 41, and 42 may be completed first whereupon pocket 29 is then inverted over the folded pile or mass thus created and the unit is complete. Device 10 is especially constructed so that it may be folded into and stored in either pocket 29 or 31, as desired, depending upon which of the surfaces 13, 14 is deployed upwardly when folding begins. In either event, the folding results in a compact, useful, and easily transportable unitary structure or package which requires no fastening means or external paraphernalia or carrying cases. When folded with the soft fleece-like surface exposed, the unit can be used as a pillow. When folded so that the weather repellant surface is exposed, it is useful as a seat cushion in both instances, one of logo 45 is exposed allowing the owner to subtly announce his/her team allegiance.

From the foregoing, it is readily apparent that a useful embodiment of the present invention has been herein described and illustrated which fulfills all of the aforestated objectives in a remarkably unexpected fashion. It is, of course, understood that such modifications, alterations and adaptations as may readily occur to the artisan confronted with this disclosure are intended within the spirit of this disclosure which is limited only by the scope of the claims appended hereto.

Accordingly, what is claimed is:

1. A self-contained multipurpose comfort device comprising:

a resilient pad; a substantially rectangular flat body portion having a first and second planar surface; said body portion having an upper end, a lower end, a proximal side edge and a distal side edge; said first planar surface being made of a first material and said second planar surface being made of a second material; a first and a second pocket member, said first pocket member being made of said first material and being secured to said first planar surface of said body portion equidistant between said proximal and distal side edges and adjacent said upper end and coacting with said first planar surface to define a first open-mouthed pocket therewith, said first open-mouthed pocket having an opening defined therein facing the center of said body portion, said second pocket member being made of said second material and being secured to said second planar surface of said body portion equidistant between said proximal and distal side edges and adjacent said lower end and coacting with said second planar surface to define a second open-mouthed pocket therewith, said second open-mouthed pocket having an opening defined therein facing the center of said body portion, said second pocket member having said resilient pad operatively mounted therewithin in registry therewith, said first and said second open-mouthed pockets each being adapted to individually receive said body portion when said body portion has been folded longitudinally and transversely to create a generally rectangular mass and expose one of said first and said second open-mouthed pockets, said rectangular mass being formed adjacent to and having substantially the same dimensions as said exposed open-mouthed pocket which, when inverted about said mass, encloses said mass into a unitary structure.

2. A device according to claim 1 in which said first material is water repellant/weather resistant material.

3. A device according to claim 1 in which said second material is a blanket material.

4. A device according to claim 1 having a logo defined on the interior surface of said first pocket member which when inverted about said mass exposes said logo to view.

5. A device according to claim 1 having a logo defined on the interior surface of said second pocket member which when inverted about said mass exposes said logo to view.

* * * * *